United States Patent [19]

Fitzgerald

[11] 4,301,731

[45] Nov. 24, 1981

[54] AIR SHOOTING SYSTEM FOR THE MINING OF COAL OR THE LIKE

[75] Inventor: John E. Fitzgerald, River Forest, Ill.

[73] Assignee: Zeto Industries, Inc., Des Plaines, Ill.

[21] Appl. No.: 74,879

[22] Filed: Sep. 12, 1979

[51] Int. Cl.[3] ..... F42D 3/04

[52] U.S. Cl. ..... 102/330; 299/21

[58] Field of Search ..... 299/16, 13, 20, 21; 102/22, 23

[56] References Cited

U.S. PATENT DOCUMENTS

| | | | |
|---|---|---|---|
| 2,083,695 | 6/1937 | Dull | 102/23 |
| 2,083,981 | 6/1937 | Armstrong | 299/20 X |
| 2,146,879 | 2/1939 | Armstrong | 102/22 R |
| 2,858,764 | 11/1958 | Hesson et al. | 102/22 R |

*Primary Examiner*—David H. Brown

*Attorney, Agent, or Firm*—Leydig, Voit, Osann, Mayer & Holt, Ltd.

[57] ABSTRACT

An air shooting system for use in lieu of explosives in the mining of coal employing a set of tubular shooting heads fitted in respective shot holes in a coal seam. Each shooting head is fed with air under high pressure and has a valve mechanism for triggering discharge of the air when it reaches a predetermined pressure. The source of air pressure is connected to a manifold and automatic shut-off valves are interposed between the manifold and the lines feeding the individual shooting heads. Each shut-off valve has a movable valve element biased into a normally open position to permit flow of air from inlet to outlet but which is snapped into closed position and held there by the inlet pressure when there is a sudden drop in pressure at the outlet accompanying discharge at the associated shooting head. The shooting heads are set to trigger in series at incrementally spaced pressures until all of the shut-off valves are in closed condition. A manual reset valve interposed between the source and the manifold cuts all flow from the source for resetting of the shut-off valves and prompt simultaneous venting of the lines feeding the shooting heads in readiness for a successive shot.

4 Claims, 9 Drawing Figures

AIR SHOOTING SYSTEM FOR THE MINING OF COAL OR THE LIKE

It has been known in the mining of coal and the like to employ air pressure in lieu of explosives by using a pressurized shooting head having a valve mechanism for the dumping of pressurized air into a shot hole as the pressure in the head reaches a predetermined triggering level. It has also been known to fire a set of shooting heads in predetermined succession to achieve the advantages of sequential shooting.

However, use of air shooting heads has been accomplished by a number of disadvantages, primarily the fact that each shooting head has been fed through an individual control valve which, in the case of a multiple shot, has required considerable time for individually controlling and manually venting each of the heads and preparing the system for a succeeding shot in a new location.

It is an object of the present invention to provide an air shooting system employing a set of shot holes in a coal seam or the like in which the shooting heads are reliably triggered in closely spaced sequence for maximum production per shot. It is a related object to provide an air shooting system which is highly efficient and economical, permitting a maximum number of productive shots per unit of time. More specifically it is an object to provide an air shooting system which, instead of employing individual control valves, enables a plurality of shooting heads to be charged, fired, and subsequently vented and reset, by single manual valve, thereby greatly simplifying the shooting process.

It is another object to provide an air shooting system which not only reduces the cycle time for shooting but which is highly economical in terms of first cost, low maintenance expense, use of a minimum amount of hose, and reduced air requirement.

It is still another object of the invention to provide an air shooting system which is much safer to use than conventional systems, in which the operator may more conveniently control a multiple shot from a remote location, and in which there is less clutter of hose, valves and the like in the working area.

Other objects and advantages of the invention will become apparent upon reading the attached detailed description and upon reference to the drawings in which.

Figure 5:
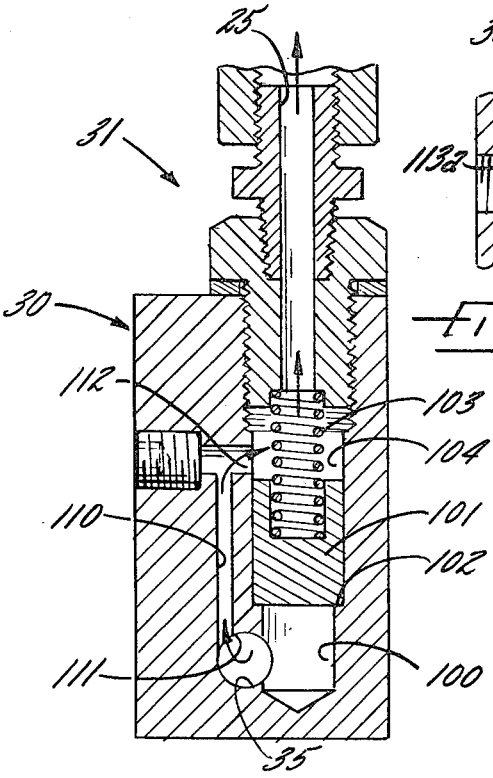
FIG. 5 is a transverse section looking along line 5—5 in FIG. 4, and showing the valve element in its open state.
Figure 5A:
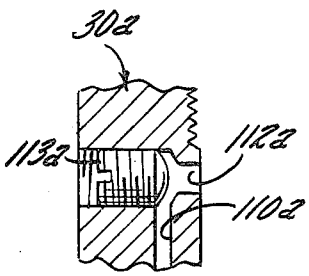

FIG. 5*a* is a fragment showing an adjustability feature.

Figure 6:
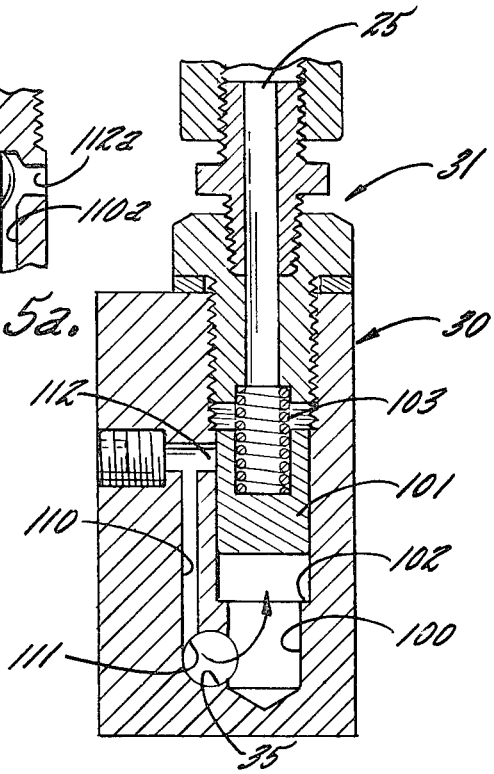

FIG. 6 is a sectional view similar to FIG. 5 but showing the valve element in its blocking state.

Figure 7:
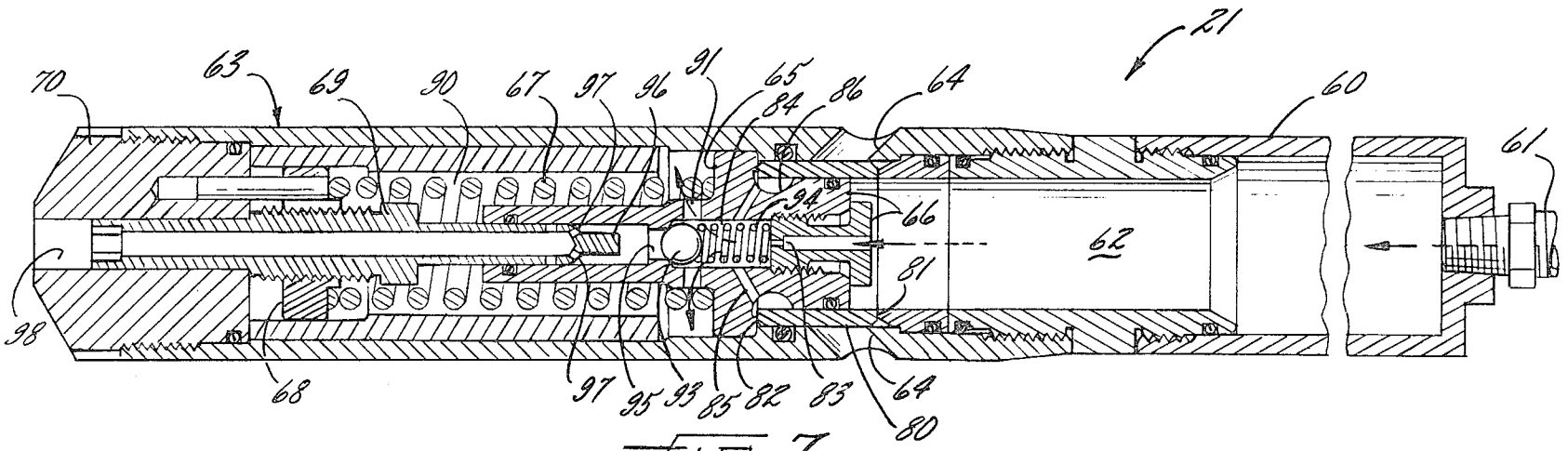

FIG. 7 shows, foreshortened, a shooting head in tubular form dimensioned to fit into a shot hole, with the parts occupying their normal charging position.

Figure 8:
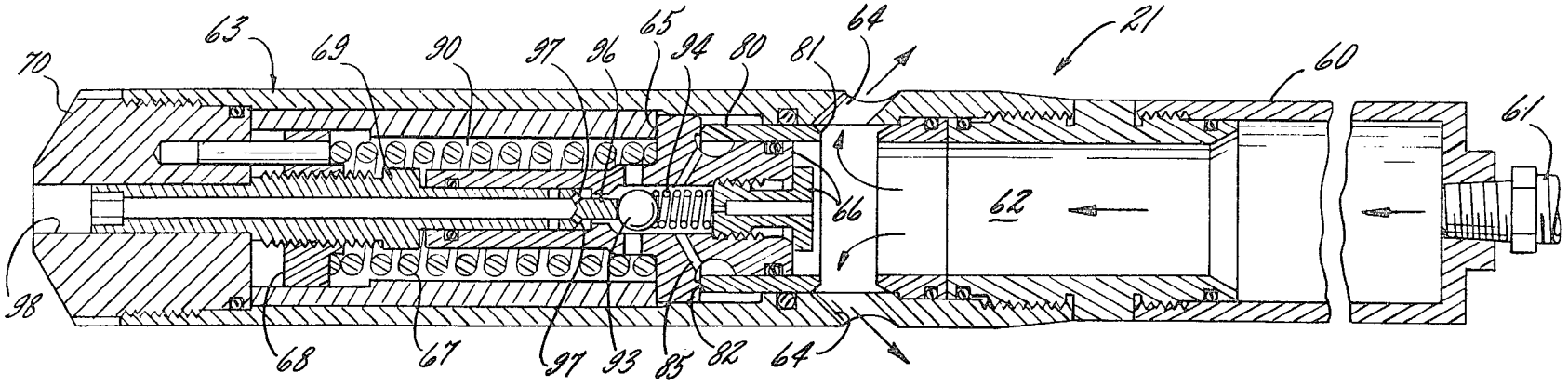

FIG. 8 is a view similar to FIG. 7 but showing the shooting head in its discharging state.

While the invention has been described in connection with a preferred embodiment, it will be understood that there is no intention to limit the invention to the embodiment shown, and I intend, on the contrary, to cover the various alternative and equivalent procedures and constructions included within the spirit and scope of the appended claims.

Figure 1:
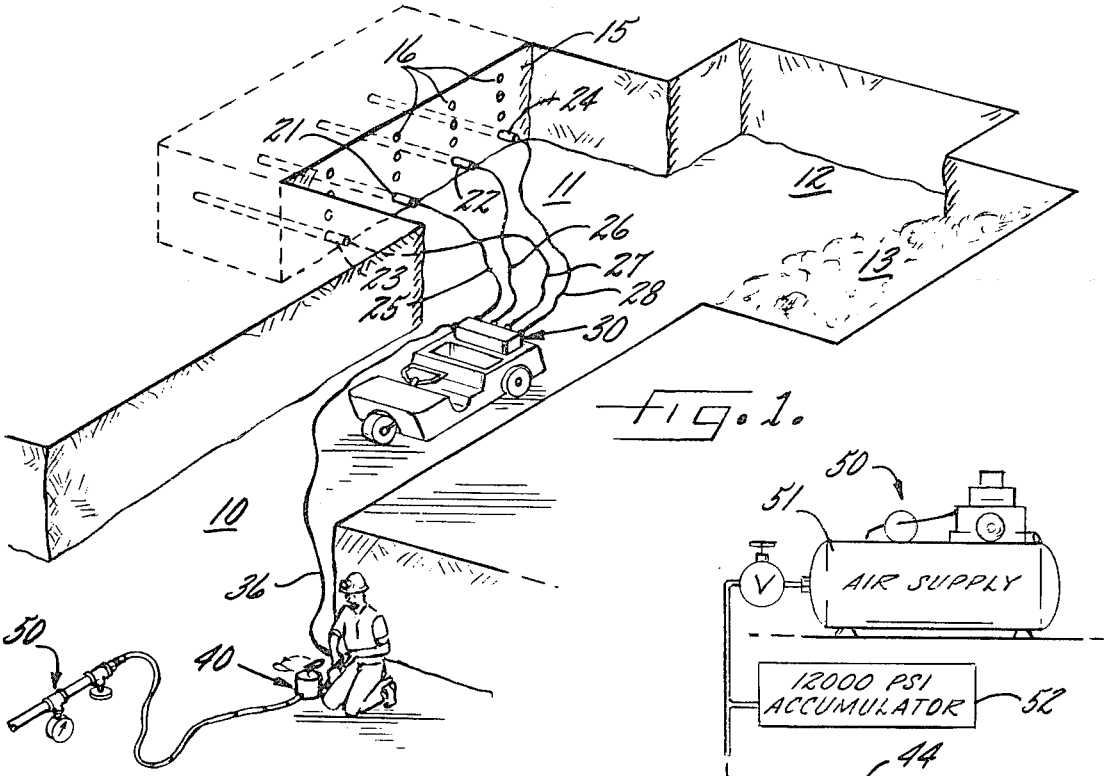
FIG. 1 shows, in perspective, a typical shooting system characteristics of the present invention.
Figure 2:
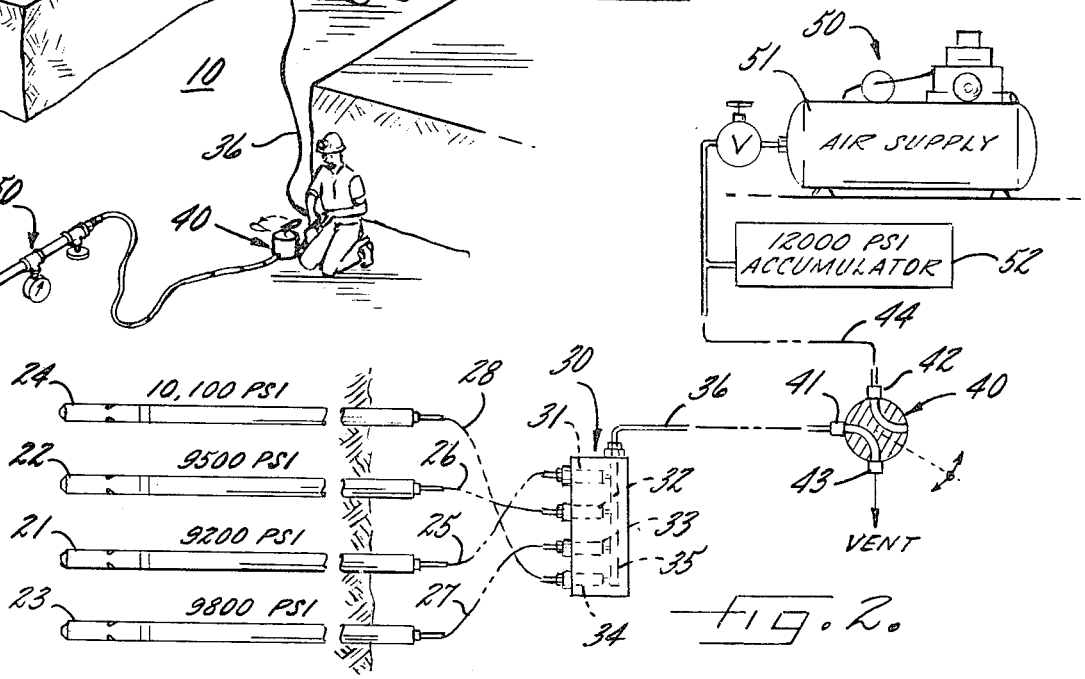
FIG. 2 is a schematic diagram corresponding to FIG. 1.

Turning now to FIG. 1 there is shown a typical gallery 10 in a coal mine having rooms 11, 12, 13. The room 11 has a vertical working face 15 into which a set of shot holes 16 have been previously drilled. Mounted in selected ones of the shot holes are a set of four shooting heads 21–24. In carrying out the invention such shooting heads are adjusted for triggering at incremental pressures and are connected by lines 25–28, respectively, to a shut-off valve assembly 30 which includes a set of four shut-off valves 31–34 (FIG. 2) inclusive with a common manifold 35. The valve assembly 30 is fed by a supply line 36 from a single threeway control valve 40 having a central port 41 and side ports 42, 43. The side port 42 is fed, via a line 44 from an air supply 50 which includes a heavy duty compressor 51 and a high pressure accumulator 52.

Prior to describing the system in detail it will be helpful to have in mind the construction of a typical shooting head, the head 21 being taken as representative, set forth in cross section in FIG. 7. Here the shooting head, also referred to as a "war head" or "shell", will be seen to include a tubular barrel 60 having an inlet 61 at its near end feeding a reservoir 62. A pressure-triggered valve mechanism 63 at its far end controls the discharge from a set of circumferentially spaced discharge ports 64.

Referring to the valve mechanism 63 in greater detail, it includes a control piston 65 having a face 66 presented to the reservoir 62, the piston being biased by a spring 67. The spring is seated upon a nut 68 which is threaded upon a central tubular spindle 69, the position of the nut, and hence the pressure triggering point, being variable by coupling the nut to a manually accessible knob 70.

Surrounding the control piston is a valve sleeve 80 having a first end 81 and a second end 82. For keeping the sleeve in its illustrated blocking position until the moment of triggering, means are provided for applying pressurized air to the end 82 of the sleeve. Such air passes from the reservoir 62 through a small axial opening 83 in the piston to a central chamber 84 which is connected by radial openings 85 to an annular chamber 86 into which the inner end 82 of the sleeve projects. Thus, when pressurized air begins to be applied in the reservoir 62 and the piston 65 begins to move, the sleeve 80 is held stationary.

For the purpose of assisting the spring 67 in opposing movement of the piston 65, pressurized air is admitted to the space surrounding the spring and which is indicated at 90. Air is admitted to such space through a set of radial openings 91 in the control piston, the openings being in communication with the chamber 84 which is fed through the small axial opening 83. Sufficient throttling occurs at the opening 83 so that, during normal use, the pressure in the space 90 is always somewhat less than the pressure in the reservoir 62, with the result that, as the pressure in the reservoir increases, the control piston 65 will gradually move to the left.

Means are provided for venting the chamber 84 and the chamber 90 when the control piston 65 reaches a predetermined point in the path of movement. Such venting means includes a ball 93 which is pressed by spring 94 so as to normally seal an opening 95 at the end of the chamber 84. For unseating the ball the hollow spindle 69 has a tip 96, with vent openings 97 adjacent the tip channeling the vented air to an external vent opening 98.

To summarize the operation of the shooting head, it will be assumed that air from a high pressure source is gradually fed through the inlet opening 61 building up pressure in the reservoir 62, causing the control piston 65 to move gradually leftward against the restoring force of the spring 67. The opposition of the spring is augmented by leakage of pressurized air through the axial opening 83 in the piston, thereby reducing the air pressure differential across the piston. The pressurized air which leaks through the opening 83, and which passes into the annular space 86 which communicates with the left-hand end of the sleeve, also serves to keep the sleeve 80 seated in its closed position. However, a point is reached where the leftward movement of the control piston causes the tip 96 of the spindle to unseat the ball 93. This performs two venting functions: In the first place it vents the chamber 90 surrounding the spring causing the piston to advance immediately to its bottomed condition illustrated in FIG. 8. Secondly, venting of the chamber 84, with the resultant venting of the annular space 86, removes axial pressure from the left-hand end 82 of the sleeve, with the result that the pressure at the right-hand end causes the sleeve to snap from the closed position illustrated in FIG. 7 immediately to the fully open position illustrated in FIG. 8 resulting in sudden discharge of the air contained in the reservoir, as well as newly arrrived pressurized air at the inlet opening 61, in the direction of the arrows. It will be noted that the air exits from the head with an axial component of force, such axial component serving to insure that the entire tubular assembly remains seated in the shot hole. The highly compressed air suddenly released in the shot hole finds its way to fissures and cracks in the seam, blasting the seam apart in the region of the hole in a manner analogous to an explosive charge. As soon as discharge of the air has taken place to the point where the spring 67 can overcome the residual pressure in the reservoir, the spring forces the control piston 65 and the valve sleeve 80 back to the closed position illustrated in FIG. 7. Where shooting takes place at a pressure on the order of 10,000 pounds per square inch, this will normally leave air in the reservoir 62 at a residual pressure of on the order of 2,000 pounds per square inch.

To summarize the operation of the shooting head, it accepts air into an associated reservoir until the pressure builds up to an adjustable triggering value at which time the air is explosively discharged, with the device thereafter resetting itself to the initial state illustrated in FIG. 7.

In accordance with the present invention each of the shooting heads 21–24, forming a set, are connected to a single pressurized manifold by means of respective automatic shut-off valves, each valve being of this type having a movable valve element biased into a normally open position to permit flow of air but which is snapped into closed position by inlet pressure, and held there, when there is a sudden drop in pressure at its outlet as discharge occurs at the associated shooting head. As a result pressure is built up simultaneously in all of the shooting heads for triggering in a predetermined series. As each shooting head is triggered, the sudden drop in pressure in its individual supply line operates the connected shut-off valve thereby isolating such head from the manifold to prevent any loss of manifold pressure. With manifold pressure thus preserved, each successive shot occurs with a degree of force and efficiency equal to the first shot.

More specifically in accordance with the invention each of the shut-off valves 31–34, the valve 31 being chosen as exemplary, includes a chamber between its inlet and outlet, with a movable valve element being arranged to seal off the chamber, while being movable between a normal position and a blocking position, the valve element having a spring for biasing it away from its blocking position. The valve body includes an air passage which extends from the valve inlet to the outlet side of the chamber, the junction with the chamber being so positioned as to be normally uncovered by the valve element to permit flow of air from the inlet to the outlet but covered by the valve element when the element is in its blocking position. The air passage is sufficiently large in cross section so that the pressure drop between the inlet and outlet during normal flow of air to the associated shooting head is not sufficient to affect the valve element but the passage is sufficiently restricted so that the pressure drop accompanying discharge of the associated shooting head is sufficient to move the piston against the force of bias into blocking position, thereby shutting off further flow of air and isolating the shooting head from the manifold.

Thus, referring to FIG. 5, the chamber, indicated at 100, and which extends from the manifold 35 to the outlet 25, is in the form of a bore containing a plunger 101 of piston shape which is normally bottomed against a stop in the form of a shoulder 102. This defines the so-called "open" position of the valve. The plunger is biased in its bottoming direction by means of a coil spring 103 which occupies the space 104 at the outlet end of the chamber 100.

In carrying out the invention an air passage 110 is provided having an inlet 111 which is connected to the manifold 35 and an outlet 112 which communicates with the outlet end 104 of the chamber. The junction of the air passage with the chamber is normally uncovered by the plunger 101, so that air can flow through the passage 110 in the direction of the arrows during normal charging of the associated shooting head, but the passage is blocked when the plunger 101 is in its upper position illustrated in FIG. 6. The cross section of the air passage 110 is important in the practice of the present invention. The passage is sufficiently large in cross section so that the pressure drop occurring between the inlet 111 and outlet 112 is not sufficient, during normal charging, to cause the plunger 101 to move upwardly to any substantial degree against the restoring force of the spring 103. However, the cross section of the air passage 110 is sufficiently restricted so that the sudden drop of pressure which occurs upon discharge of the associated shooting head (and which is typically a drop from around 10,000 to around 2,000 pounds per square inch) does create a sufficient pressure differential across the plunger 101 to overcome the restoring pressure of spring 103 so that the plunger, upon discharge at the shooting head, is immediately snapped into its upper position illustrated in FIG. 6, thereby shutting off the outlet 112 of the air passage and preventing further flow of air through the passage, the plunger thereafter remaining in its blocked position until it is subsequently reset. It will be apparent, upon viewing FIG. 6, that this isolates the head which has been fixed from pressure manifold 35 so that full pressure is maintained in the manifold during the subsequent discharge of shooting heads later in the series. Indeed as further pressurized air flows through the manifold and into the shooting heads of the series which are still being charged, the pressure in the manifold, in the lines leading to the shooting heads, and in the reservoirs of the shooting heads will increase to bring about successive discharge of the remaining shooting heads at pressures which are incrementally related. In a practical case the shooting head 21 which is set to go off at the lowest pressure may be set to trigger at 9,200 pounds per square inch while the shooting head 24 intended to discharge at the highest pressure may be set to trigger at 10,100 pounds, with the central heads being adjusted to intervening values at increments of 300 pounds per square inch. In practice, using a conventional heavy duty air compressor 51 and accumulator 52 having a nominal rating of 12,000 pounds per square inch, setting the shooting heads at 300 pound increments will normally cause a delay time, between successive shots.

If desired, the effective cross section of the air passage 110 may be made adjustable as set forth in FIG. 5*a*, where similar elements carry similar reference numerals. A set screw 113*a* may be used in lieu of the stationary plug shown in the main embodiment.

In accordance with one of the aspects of the present invention a single manual control-reset valve is interposed between the source and the manifold for cutting off flow of pressurized air from the source and for simultaneously venting the manifold thereby causing the shut-off valves 31–34 to be restored to normally open position for prompt simultaneous venting of the feed lines preparatory to relocation of the shooting heads in a succeeding set of shot holes.

Control of the shot and the simultaneous shut-off and venting function is performed by the three-way valve 40. Under charging conditions the valve rotor occupies a position in which the ports 41, 42 are interconnected. Manually turning the valve to such position causes immediate charging and pressure build-up in the shooting heads to produce sequential discharge as previously discussed. After all of the shooting heads have fired, all of the shut-off valves 31–34 will be in the closed condition illustrated in FIG. 6 and the maximum pressure of the accumulator will exist in line 36. To achieve simultaneous venting of all of the shooting heads, their associated lines 25–28, manifold 35 and its single supply line 36, and for resetting all of the valves 31–34 to the initial state illustrated in FIG. 5, the reset valve 40 is turned to the illustrated position. The first effect of such turning is that the port 42 leading to the source is blocked off so that no air may idly escape from the accumulator. As the reset valve completes its movement, line 36 and port 41 are connected to the venting port 43 which is open to the atmosphere. This drops the pressure in the manifold to near atmospheric so that all of the plungers 101 in the shut-off valve are released, moving to the lower, or open, position illustrated in FIG. 5, and causing a bleeding or venting of residual air from all of the shooting heads 21–24 and their respective supply lines 25–28, with such venting taking place in a direction opposite to the arrows shown in FIG. 5. It takes but a moment to move the manual valve 40 to its reset position and only a short additional time, measured in seconds, for venting of the shooting heads and their associated lines. The short venting time is due to the relatively limited capacity of these elements plus the fact that all of them are vented simultaneously. A further factor which contributes to the short venting time as well as to economy in use of air is the fact that each of the supply lines 25–28 is isolated at its moment of lowest pressure, that is, residual pressure, so that there is no need to bleed the lines or the reservoirs down from a higher level. In any event the operator, having operated a single valve, is promptly freed to proceed into the room in which the shot has taken place to remove the shooting heads and to relocate them in a succeeding set of shot holes.

Figure 3:
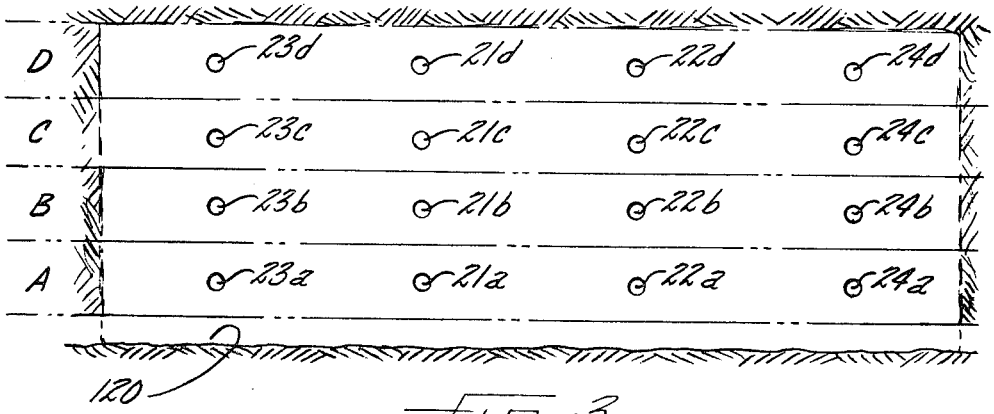
FIG. 3 illustrates a typical and efficient shooting sequence in the face of the coal seam.
Figure 4:
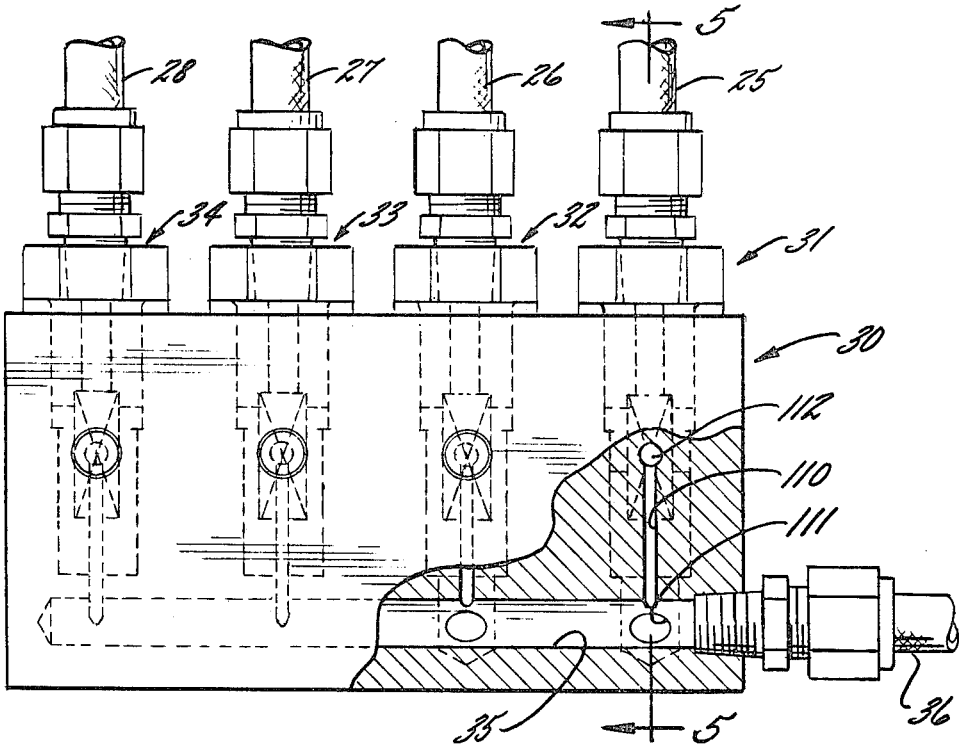
FIG. 4 is a side elevation, with a portion broken away, showing a cut-off valve assembly having a unitary valve body.

A typical and efficient pattern of shot hole placement which may be utilized in the present invention is illustrated in FIG. 3 where the face of the seam is divided into four horizontal areas indicated at A–D. It will be understood that before the shooting takes place the face 15 will have been undercut by a deep groove 120 to a depth which depends upon the length dimension of the shooting heads. The first shot occurs in area A where the shooting heads 21–24, with letter subscript, are distributed as shown and a shot is made. The shooting heads are then inserted in shot holes in area B where a second shot is made. This process is repeated for areas C and D. This results in a cleared opening and broken coal of consistent size, largely free of fines, the broken coal being removed by conventional equipment well known to those skilled in the art.

It will be apparent that the above described procedure and apparatus amply carries out the objects of the invention. The sequential shooting of the heads results in efficient, programmed breakage for efficient removal on a high production basis. Since only a single control-reset valve is employed and since both charging and venting of the separate heads and their supply lines occur simultaneously, the time between successive shots may be reduced to a small fraction of that previously required. The set-up is both simple and safe, enabling the operator to charge and fire the shooting heads from a remote location by means of only a single hose. The system is inherently economical in first cost, employing a minimum amount of hose and using up a minimum amount of pressurized air, while maintenance is reduced to a minimum.

The term "manifold" used herein refers to any single pressurized chamber or passage fed from the pressurized source and which communicates simultaneously with the inlet ports of all of the shut-off valves 31–34 comprising a set. While a manual control and reset valve 40 has been employed with a single manual operator movable in opposite directions for (a) firing and (b) venting and reset, it will be understood that the term "valve" used in connection with the device 40 shall be understood to cover not only single valves but multiple valves, as well, which may be employed to carry out the stated functions; for example, the functions of cutting off the flow of pressurized air from the source and cutting off the flow of pressurized air from the source and venting of the manifold may be performed by separate sequentially operated valve mechanisms without departing from the invention. Moreover, the term "manual" employed in connection with the valve 40 is intended to include remote push button operation, for example by means of a solenoid or the like, as well as direct application of manual force.

I claim:

1. In an air shooting system for a set of shot holes in a coal seam or the like, the combination comprising a set of tubular shooting heads dimensioned to fit in the respective shot holes and each having a head inlet at the near end supplied by an individual feed line, a reservoir in the head fed by the inlet, means defining a discharge port adjacent the far end of the head, each shooting head having a valve mechanism interposed between the reservoir and the discharge port for blocking the discharge port as pressure is progressively built up in the reservoir, the valve mechanism including pressure responsive means for suddenly opening the discharge port as the pressure reaches a triggering level to release pressurized air in the shot hole for splitting of the seam, a source of high pressure air, a manifold connected to the source, a set of automatic shut-off valves interposed between the manifold and the individual feed lines, each shut-off valve having an inlet and an outlet and having a movable shut-off valve element interposed between the inlet and outlet for controlling air flow through a restricted air passage, the movable valve element being exposed on opposite sides to the pressures at the inlet and outlet and biased into a normally open position to permit gradual flow of air through the restricted air passage to the outlet but with the differential pressure resulting from the sudden drop in pressure at the outlet, as discharge occurs at the associated shooting head, serving to snap the valve element into closed position cutting off further flow, the valve element being thereafter held in closed position by the pressure at the inlet, the pressure responsive means in the respective shooting heads being adjustable to trigger at incrementally spaced levels in a predetermined series so that, as air pressure is built up simultaneously in the reservoirs of all of the shooting heads, the shooting head lowest in the series is triggered for discharge causing a sudden drop in pressure at the outlet of the associated shut-off valve thereby shutting off further flow of air thereto and isolating such head from the manifold to prevent loss of manifold pressure, with the process being repeated for each successive shooting head in the series until all of the shut-off valves are in closed condition, and means including a manual control and re-set valve interposed between the source and the manifold for cutting off flow of pressurized air from the source to the manifold and venting the manifold to remove pressure at the inlets of the shut-off valves so that the valve elements thereof are restored to normally open position to achieve prompt simultaneous venting of the feed lines preparatory to removal of the shooting heads for re-location in a succeeding set of shot holes.

2. The combination as claimed in claim 1 in which the movable valve element is in the form of a piston slidable in a bore and in which the restricted air passage extends from the manifold to the side wall of the bore at a position adjacent the valve outlet so that flow of air through the passage to the outlet is cut off by the piston when the latter is in its closed position.

3. The combination as claimed in claim 1 in which the set of automatic shut-off valves is accommodated in a single valve body, the valve body including the manifold and a plurality of bores each bore having an inner end and an outer end, the inner ends of the bores being in communication with the manifold, the outer ends of the bores communicating with the individual feed lines, pistons slidable in the bores so that the inner ends of the pistons are exposed to manifold pressure while the outer ends of the pistons are exposed to feed line pressure, springs for biasing the respective pistons in the direction of the inner ends of the bores to define an open position, each piston being by-passed by the restricted air passage when in open position, the air passage extending from the manifold and terminating at the wall of the bore adjacent its outer end so that upon sudden drop of pressure in a feed line the associated piston moves from its normally open position to a closed position in which the restricted passage is closed off, in which position it is held by the pressure in the manifold.

4. The combination as claimed in claim 1 in which the control and reset valve is in the form of a three-way valve having a central port connected to the manifold and side ports connected respectively to the source of pressurized air and to the atmosphere, the valve having a manually controlled actuator shiftable between a first position in which (a) the central port is connected to the source of pressurized air so that air flows through the shut-off valves for simultaneously charging the reservoirs and a second position in which (b) the central port is connected to the atmosphere for venting the manifold and the feed lines supplied therefrom.

* * * * *

UNITED STATES PATENT AND TRADEMARK OFFICE

CERTIFICATE OF CORRECTION

PATENT NO. : 4,301,731

DATED : 11/24/81

INVENTOR(S) : John E. Fitzgerald

It is certified that error appears in the above—identified patent and that said Letters Patent is hereby corrected as shown below:

Column 1, lines 13-14, delete "accomplished" and insert -- accompanied --

Column 1, line 51, change "characteristics" to -- characteristic --

Column 3, line 61, after the word "of" delete "this" and insert -- the --

Column 6, line 57, delete "cut-"

Column 6, delete line 58

Signed and Sealed this

Sixteenth Day of March 1982

[SEAL]

*Attest:*

GERALD J. MOSSINGHOFF

*Attesting Officer*

*Commissioner of Patents and Trademarks*